US009157432B2

(12) United States Patent
Yoda et al.

(10) Patent No.: US 9,157,432 B2
(45) Date of Patent: Oct. 13, 2015

(54) COMPRESSION APPARATUS

(75) Inventors: Kazuyuki Yoda, Kako-gun (JP); Kai Nakanishi, Kako-gun (JP); Tsuyoshi Niimura, Kako-gun (JP)

(73) Assignee: (Kobe Steel, Ltd.), Kobe-shi (JP)

( * ) Notice: Subject to any disclaimer, the term of this patent is extended or adjusted under 35 U.S.C. 154(b) by 632 days.

(21) Appl. No.: 13/547,829

(22) Filed: Jul. 12, 2012

(65) Prior Publication Data

US 2013/0039741 A1 Feb. 14, 2013

(30) Foreign Application Priority Data

Aug. 12, 2011 (JP) ..... 2011-176535

(51) Int. Cl.

| | |
|---|---|
| ***F04B 49/00*** | (2006.01) |
| ***F04B 49/06*** | (2006.01) |
| ***F04C 18/16*** | (2006.01) |
| ***F04C 28/08*** | (2006.01) |
| ***F04C 28/24*** | (2006.01) |
| ***F04B 15/02*** | (2006.01) |

(52) U.S. Cl.

CPC ..... *F04B 49/06* (2013.01); *F04B 15/02* (2013.01); *F04B 49/065* (2013.01); *F04C 18/16* (2013.01); *F04C 28/08* (2013.01); *F04C 28/24* (2013.01)

(58) Field of Classification Search

CPC ..... F04B 15/02; F04B 49/06; F04C 28/08; F04C 28/24

USPC ..... 417/26, 28, 295

See application file for complete search history.

(56) References Cited

U.S. PATENT DOCUMENTS

| | | | | |
|---|---|---|---|---|
| 4,473,093 | A * | 9/1984 | Hart | 137/522 |
| 4,720,245 | A * | 1/1988 | Takata et al. | 417/28 |
| 6,146,100 | A * | 11/2000 | Broucke | 417/28 |
| 6,461,112 | B1 * | 10/2002 | Ohta et al. | 417/26 |
| 9,010,459 | B2 * | 4/2015 | Field et al. | 175/25 |
| 2002/0021969 | A1 * | 2/2002 | Totsuka | 417/26 |
| 2007/0110587 | A1 * | 5/2007 | Takeshita | 417/26 |

FOREIGN PATENT DOCUMENTS

| | | |
|---|---|---|
| JP | 1-313694 | 12/1989 |
| JP | 9-287580 A | 11/1997 |

* cited by examiner

*Primary Examiner* — Charles Freay

(74) *Attorney, Agent, or Firm* — Oblon, McClelland, Maier & Neustadt, L.L.P.

(57) ABSTRACT

This invention provides a compression apparatus capable of flexibly responding to a change in service condition. The compression apparatus comprises a compressor main body for housing rotatively driven rotors, an intake channel connected to an intake port of the compressor main body and equipped with a suction adjusting valve, a discharge channel connected to a discharge port of the compressor main body and equipped with a discharge pressure sensor, a revolution speed setting unit for causing a rotor to have a revolution speed that matches a set number of revolutions, a valve controlling unit for controlling the suction adjusting valve based on a discharge pressure detected by the discharge pressure sensor in such a manner that a pressure of the discharge channel is maintained at a set pressure, and a controller for defining the set number of revolutions and the set pressure based on a condition selected by a user.

6 Claims, 4 Drawing Sheets

| CONDITION | SET PRESSURE (MPa) | AIR DISCHARGE RATE ($m^3$/min) | SET NUMBER OF REVOLUTIONS (rpm) |
|---|---|---|---|
| CONDITION 1 | 0.70 | 10.0 | R1 |
| CONDITION 2 | 0.85 | 8.0 | R2 |
| CONDITION 3 | 0.90 | 6.0 | R3 |

FIG. 2

| CONDITION | SET PRESSURE (MPa) | AIR DISCHARGE RATE ($m^3$/min) | SET NUMBER OF REVOLUTIONS (rpm) |
|---|---|---|---|
| CONDITION 1 | 0.70 | 10.0 | R1 |
| CONDITION 2 | 0.85 | 8.0 | R2 |
| CONDITION 3 | 0.90 | 6.0 | R3 |

COMPRESSION APPARATUS

BACKGROUND OF THE INVENTION

1. Field of the Invention

The present invention relates to a compression apparatus.

2. Description of the Related Art

As described in Japanese Unexamined Patent Application Publication No. H01-313694, there have been known compressors with structure for rotatively driving compressor rotors composed of a pair of male and female screw rotors by means of a motor or the like device that functions as a driving machine through a pulley with a belt, or a speed increasing or decreasing gear implemented by a combination of main and pinion gears.

In the compressors, the inside of a package is divided into two internal spaces. The internal space of a primary side houses a compressor main body, the motor for driving the screw rotors in the compressor main body through the pulley with the belt, and an oil separation and recovery unit. On the other hand, the internal space of a secondary side is equipped with a sirocco fan attached to an output shaft of the motor, an after cooler, and an oil cooler. Further, an air inlet is disposed on an outer wall of the internal space of the primary side, while a through hole for allowing air to flow from the internal space of the primary side to the internal space of the secondary side is formed in the partition wall.

To adjust a revolution speed in such a compression apparatus, the diameter of the pulley, geometry of the belt, a gear ratio, or other features must be changed (i.e. replacement work for replacing components such as the pulley, the belt, or the gear should be performed). However, the replacement work requires a certain amount of time. For this reason, it is unpractical, in the compressor of the above-described type, to frequently change service conditions of the compressor, such as specifications of an object to which compressed air is supplied.

SUMMARY OF THE INVENTION

An object of the present invention is to provide a compression apparatus capable of flexibly responding to a change in a service condition, the compression apparatus that rotatively drives compressor rotors, such as a pair of male and female screw rotors.

To solve the above object, the present invention provides a compression apparatus comprising a compressor main body that houses a rotor to be rotatively driven, an intake channel connected to an intake port of the compressor main body, a suction adjusting valve disposed in the intake channel, a discharge channel connected to a discharge port of the compressor main body, a discharge pressure sensor disposed in the discharge channel, a revolution speed setting unit that causes the rotor to have a revolution speed matched to a set number of revolutions, a valve controlling unit that controls the suction adjusting valve based on a discharge pressure detected by the discharge pressure sensor in such a manner that a pressure of the discharge channel is maintained at a set pressure, and a controller that determines the set number of revolutions to send the set number of revolutions to the revolution speed setting unit, and determines the set pressure to send the set pressure to the valve controlling unit. In the compression apparatus, the controller stores a plurality of service conditions, each of which consists of a pair of a value of the set number of revolutions and a value of the set pressure, and determines the set number of revolutions and the set pressure in accordance with a service condition selected from among the plurality of service conditions.

According to the above-described configuration, the revolution speed setting unit defines a capacity of the compressor main body based on the number of revolutions and the discharge pressure corresponding to the selected service condition, while the valve controlling unit causes the discharge pressure to be precisely matched to a set condition. In this way, it becomes possible to easily change the service condition without having to perform component replacement or other operation which is otherwise necessitated by a change in the service condition.

In the compression apparatus of this invention, the set number of revolutions may be set to a value corresponding to the selected condition and fixedly maintained at the value.

Alternatively, in the compression apparatus of this invention, the controller may cause, depending on a degree of opening of the suction adjusting valve, the set number of revolutions to be increased or decreased from the set number of revolutions associated with the selected condition. According to this configuration, a length of time that a discharge is reduced by means of the suction adjusting valve (a length of time of operation performed under a no-load condition) is maintained at an appropriate rate, which can contribute to high energy efficiency (a reduced consumption of power), and provide capability of responding to a change in load.

Further, in the compression apparatus of this invention, the suction adjusting valve may be a switching valve which is switched between a fully closed state and a fully opened state, and the controller may cause the set number of revolutions to be increased or decreased depending on a percentage of a length of time that the suction adjusting vale is in the fully closed state with respect to a unit of time.

According to this configuration, the length of time the discharge is reduced by means of the suction adjusting valve (the length of time of operation performed under the no-load condition) is maintained at the appropriate rate, which can contribute to high energy efficiency (the reduced consumption of power), and provide capability of responding to the change in load.

Still further, in the compression apparatus of this invention, the controller may cause the set number of revolutions to be decreased by a first fixed amount when a full close rate, which is the percentage of the length of time that the suction adjusting valve is in the fully closed state with respect to the unit of time, is greater than a predetermined high rate limit, or to be increased by a second fixed amount when the full close rate is smaller than a predetermined low rate limit.

According to this configuration, because computation of the set number of revolutions is simplified, the controller can be implemented at low cost.

Moreover, in the compression apparatus of this invention, the controller may determine an initial value of the set number of revolutions based on an input from a user, and prevent the set number of revolutions from being increased when the set number of revolutions is greater than or equal to the initial value.

In this configuration, when an actual load exceeds a service condition selected by a user, the compression apparatus is not allowed to accordingly increase its output, thereby preventing the consumption of power from increasing beyond a maximum power estimated under the service condition selected by the user.

BRIEF DESCRIPTION OF THE DRAWINGS

FIG. 2 is a table showing set conditions for the compression apparatus of FIG. 1;

DESCRIPTION OF THE PREFERRED EMBODIMENTS

Figure 1:
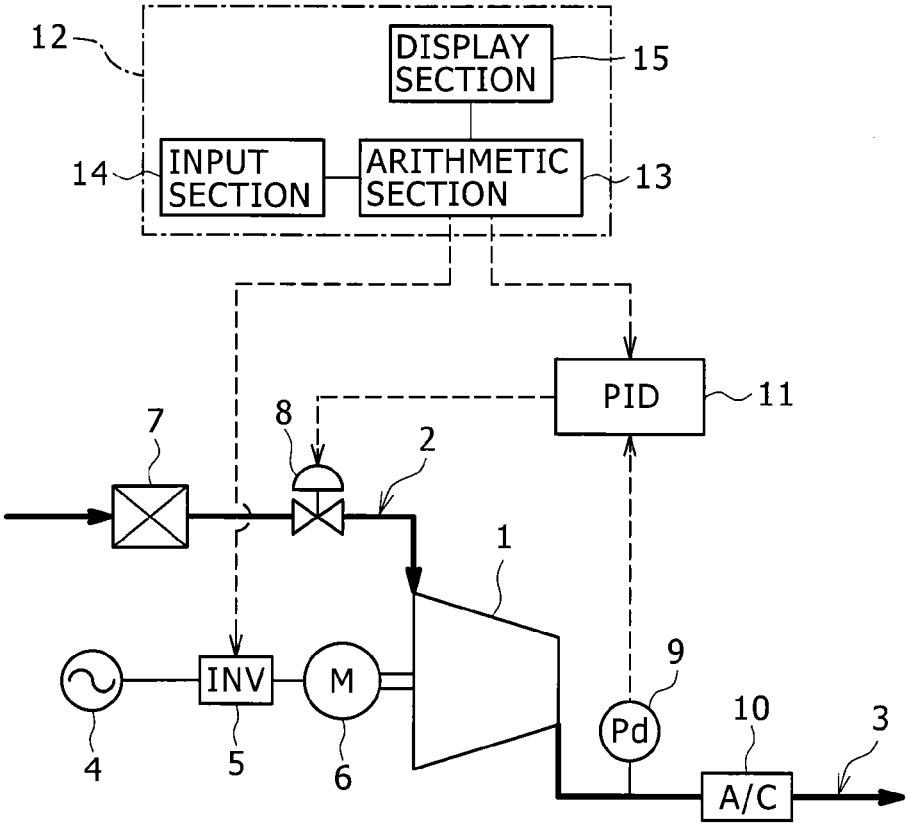
FIG. 1 is a configuration diagram showing a compression apparatus according to a first embodiment of the present invention.

Hereinafter, embodiments of the present invention will be described with reference to the drawings. FIG. 1 shows a configuration of a compression apparatus according to a first embodiment of this invention. The compression apparatus of this embodiment includes a compressor main body 1 that houses a pair of intermeshing male and female screw rotors to compress air by means of the screw rotors, an intake channel 2 connected to an intake port of the compressor main body 1, and a discharge channel 3 connected to a discharge port of the compressor main body 1.

The screw rotors in the compressor main body 1 are rotatively driven by a motor 6 whose revolution speed can be set through an inverter 5 (a revolution speed setting unit) connected to an alternating current source 4. The intake channel 2 is equipped with an air filter 7 and a suction adjusting valve 8. The discharge channel 3 is equipped with a discharge pressure sensor 9 and an after cooler 10.

The suction adjusting valve 8 is designed to have an opening the degree of which is adjusted by a PID controller 11 (a valve controlling unit). More specifically, the PID controller 11 performs PID control of the degree of opening of the suction adjusting valve 8 based on a discharge pressure Pd detected by the discharge pressure sensor 9 in such a manner that a pressure of the discharge channel 3 is maintained at a predetermined set pressure Pd_set.

A set number of revolutions of the screw rotors Rev_set to be established by the inverter 5 (a set frequency of the inverter 5) and the set pressure Pd_set to be established by the PID controller 11 are specified by a controller 12. The controller 12 includes an arithmetic section 13 having a microprocessor, an input section 14, such as a keyboard or a switch, which allows a user (an operator) to provide an input, and a display section 15 such as a display.

In this embodiment, the controller 12 specifies the set number of revolutions Rev_set and the set pressure Pd_set based on a table shown in FIG. 2. The arithmetic section 13 previously stores data indicated in FIG. 2. The user selects any one (a condition 1, a condition 2, or a condition 3) of the three conditions indicated in FIG. 2. The air discharge rates listed in FIG. 2 are provided as a rough indication of an amount of available air under each of the conditions for use as a reference to help the user in selecting the condition, and they are not intended to be relevant with any control of the compression apparatus.

The set number of revolutions Rev_set is specified to a revolution speed at which the compressor main body 1 is able to sufficiently provide the air discharge rates listed in FIG. 2 as long as the discharge pressure Pd is maintained at the set pressure Pd_set. The PID controller 11 adjusts the degree of opening of the suction adjusting valve 8 to thereby regulate the pressure of air at the intake port of the compressor main body 1 in such a manner that the discharge pressure Pd is maintained at the set pressure Pd_set.

In this way, the compression apparatus according to this embodiment is capable of causing the discharge pressure and the air discharge rate to be changed only by an input to the controller 12. Specifically, operation to adjust (change) the number of revolutions in response to a change in specifications of an object to which compressed air is supplied (a change in service condition of the compressor) has conventionally necessitated replacement work of replacing a component such as a pulley, a belt, or a gear with another one, or installation of a massive mechanical speed changing means. In contrast, when the compression apparatus of this embodiment is employed, the change in specifications of the object to which compressed air is supplied can be accommodated only by the input to the controller 12 without accompanying any action such as the above-described replacement work. Meanwhile, components such as the pulley, the belt, or the gear are no longer necessary for a power transmission means, and instead, an inexpensive inverter having relatively simple structure can be employed as described below in place of the components.

In this embodiment, the inverter 5 only has to realize, as the set number of revolutions Rev_set, any one of the numbers of revolutions listed in FIG. 2, and need not make a frequent change in value of the set number of revolutions Rev_set. In this regard, an inexpensive inverter with relatively simple structure may be used as the inverter 5. Moreover, instead of a combination of the inverter 5 and the motor 6, another combination such as a combination of a pole change motor and a pole selecting circuit may be used.

Although the controller 12 internally stores data on the table of FIG. 2 in this embodiment, the data may be stored in another device (for example, a higher level computer). Then, values of the set number of revolutions and the set pressure may be sent to the controller 12 in accordance with a selection of a condition. In this case, the controller 12 and the above-described another device combined together constitute a controller that is embraced in a concept of the controller of this invention.

Figure 3:
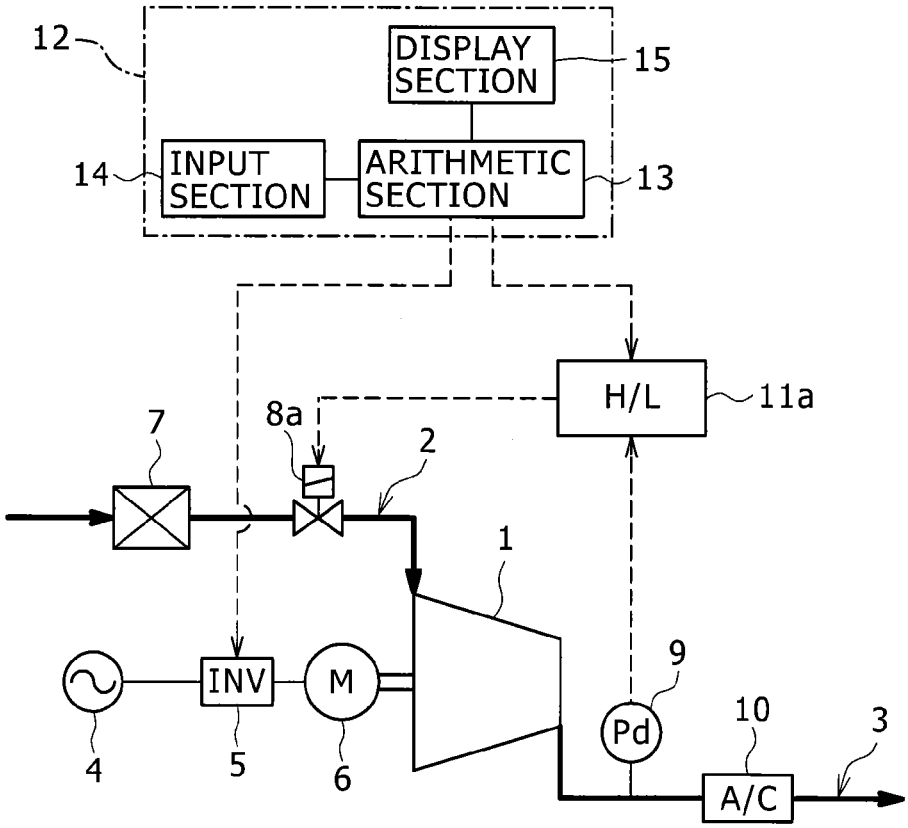
FIG. 3 is a configuration diagram showing a compression apparatus according to a second embodiment of the present invention.

In addition, FIG. 3 shows another configuration of the compression apparatus according to a second embodiment of this invention. In description of the second embodiment, the same components as those of the first embodiment are designated by the same reference numerals, and the descriptions related to the components will not be repeated. In the compression apparatus of the second embodiment, the suction adjusting valve is a switching valve 8*a* which is switched between a fully opened state and a fully closed state. Because of this, a HI/LO controller 11*a* for performing high-low control is used as a valve controlling means that controls the suction adjusting valve 8*a*.

Figure 4:
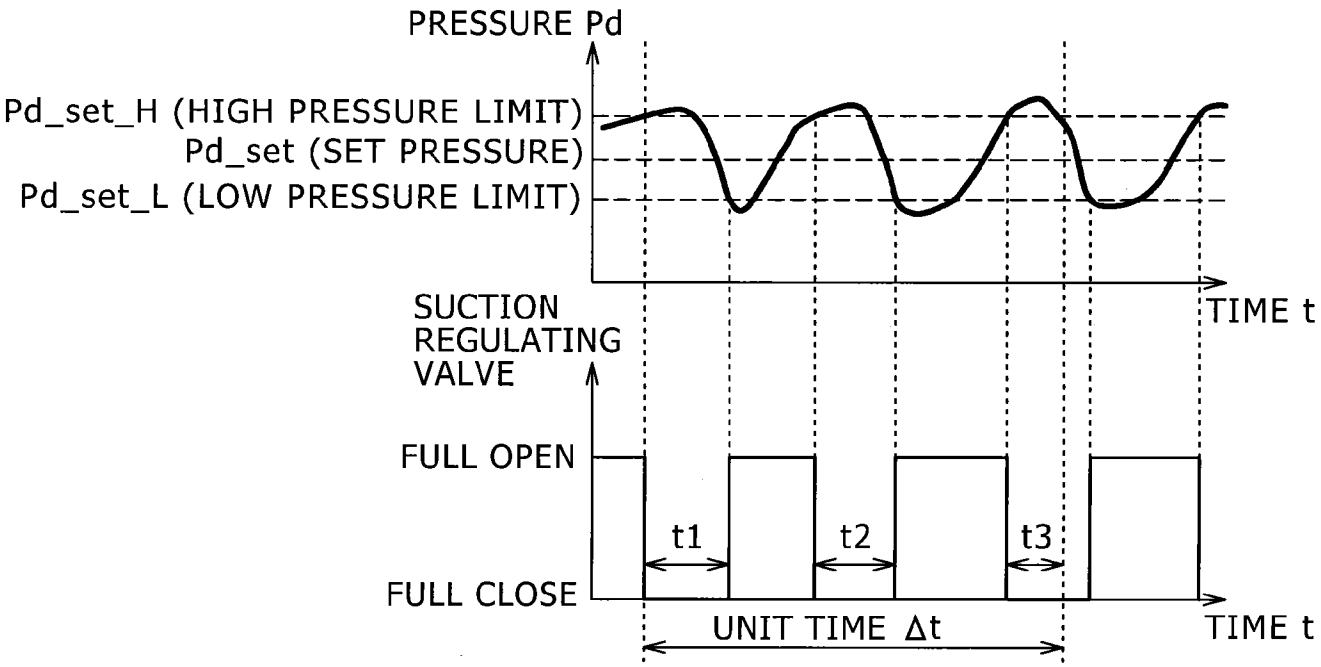
FIG. 4 is a diagram showing an example of a change in discharge pressure and a state change of a suction adjusting valve in the compression apparatus of FIG. 3.

The HI/LO controller 11*a* closes the suction adjusting valve 8*a*, as shown in FIG. 4, and accordingly causes the compressor main body 1 to operate under a no-load condition when the discharge pressure Pd reaches or exceeds a predetermined high pressure limit Pd_set_H, or opens the suction adjusting valve 8*a* and accordingly causes the compressor main body 1 to operate under a full load condition when the discharge pressure Pd drops to or below a predetermined low pressure limit Pd_set_L. The high pressure limit Pd_set_H and the low pressure limit Pd_set_L are predefined for each of the service conditions to be selected by the user.

In this embodiment, the controller 12 makes an adjustment to the set number of revolutions Rev set used in the inverter 5 from moment to moment. An initial value Rev_spec of the set number of revolutions Rev_set is predefined for each of the conditions to be selected by the user. The initial value Rev_spec is also intended to be an upper limit value of the set number of revolutions Rev_set of the inverter 5 under a selected service condition.

The controller 12 calculates a full close rate ($tr=\Sigma tn/\Delta t$) which is a percentage of a length of time (t1, t2, t3) that the suction adjusting valve 8*a* is in the fully closed state with respect to a predetermined unit of time Δt. Then, the controller 12 decreases the set number of revolutions Rev_set by a predetermined first fixed value ΔR1 when the full close rate tr is greater than a predetermined high rate limit tr_H, or increases the set number of revolutions Rev_set by a predetermined second fixed value ΔR2 when the full close rate tr is smaller than a low rate limit tr_L.

When the suction adjusting valve 8*a* is fully closed, the compressor main body 1 generates no compressed air, but still consumes a fraction (for example, approximately 20%) of the power consumed at full load. With this in view, the high rate limit tr_H is defined to be as small as possible within a controllable range, thereby preventing occurrence of an excessively high close rate tr. As a result, the consumption of power of the compression apparatus can be reduced.

Here, when the full close rate tr is higher than the predetermined high rate limit tr_H, the set number of revolutions Rev_set may be reduced by the predefined first fixed value ΔR1, to thereby decrease a subsequently-obtained full close rate tr, i.e. reduce a percentage of operation performed under the no-load condition. On the contrary, when the full close rate tr is lower than the predetermined low rate limit tr_L, the set number of revolutions Rev_set may be increased by the predetermined second fixed value ΔR2, which can prevent, even when the load is increased, occurrence of a situation where the set number of revolutions is still low while the suction adjusting valve 8*a* remains full open. In other words, it can be avoided that the high/low state of the suction adjusting valve 8*a* is not properly controlled. This means that, in this embodiment, the length of time the discharge is reduced by means of the suction adjusting valve (the length of time of operation performed under the no-load condition) is maintained at an appropriate rate, which can lead to high energy efficiency (a reduced consumption of power), and provide capability of responding to a change in load. In addition, because calculation of the set number of revolutions is simplified, it is possible to implement the controller 12 at low cost.

Further, the initial value Rev_spec of the set number of revolutions Rev_set is a highest revolution speed under the service condition selected by the user. Then, even in a case where the full close rate tr is below the predetermined low rate limit tr_L, the controller 12 does not cause a further increase of the set number of revolutions Rev_set as long as the set number of revolutions Rev_set established in that case matches or exceeds the initial value Rev_spec. In this way, even when the actual load is increased beyond expectation of the user, it is ensured that the consumption of power of the compression apparatus is increased only up to a value determined by the selected service condition (the consumption of power is prevented from being increased beyond the maximum power expected under the service condition selected by the user).

When the initial value Rev_spec is not used as the upper limit value, individual upper and lower limit values of the set number of revolutions Rev_set may be additionally determined depending on specifications of the inverter 5 and the motor 6. In this case, the initial value Rev_spec is only used for defining a capacity of the compression apparatus at the time of startup.

For the first and second fixed values ΔR1, ΔR2, it is preferable that their optimum values are previously selected based on a unit of time Δt and a rated revolution speed of the compressor main body 1, and stored in the arithmetic section 13 of the controller 12. The fixed values ΔR1, ΔR2 may be found in various ways including a simulation, an empirical and experimental manner, etc.

Moreover, the technique of adjusting the set number of revolutions in the second embodiment may be applied to the first embodiment. In this case, because the degree of opening of the suction adjusting valve is continuously changed, the technique is applied, for example, as described below. That is, the controller 12 calculates an integral value of the degrees of opening of the suction adjusting valve 8*a* for the predetermined unit of time Δt. Then, the controller 12 decreases the set number of revolutions Rev_set by the predetermined first fixed value ΔR1 when the integral value of the degrees of opening is smaller than a predetermined low limit value, or increases the set number of revolutions Rev_set by the predetermined second fixed value ΔR2 when the integral value of the degrees of opening is greater than a predetermined high limit value.

What is claimed is:

1. A compression apparatus comprising:

a compressor main body that houses a rotor to be rotatively driven;

an intake channel connected to an intake port of the compressor main body;

a suction adjusting valve disposed in the intake channel;

a discharge channel connected to a discharge port of the compressor main body;

a discharge pressure sensor disposed in the discharge channel;

a revolution speed controlling unit that causes the rotor to have a revolution speed matched to a set number of revolutions;

a valve controlling unit that controls, based on a discharge pressure detected by the discharge pressure sensor, the suction adjusting valve in such a manner that a pressure of the discharge channel is maintained at a set pressure, and a controller that determines the set number of revolutions and sends the set number of revolutions to the revolution speed controlling unit, and determines the set pressure to send the set pressure to the valve controlling unit, wherein;

the controller stores a plurality of service conditions, each of which consists of a pair consisting of a value of the set number of revolutions and a value of the set pressure, and determines the set number of revolutions and the set pressure in accordance with a service condition selected from among the plurality of service conditions.

2. The compression apparatus according to claim 1, wherein the set number of revolutions is fixed to a value of the set number of revolutions corresponding to a selected one of the service conditions.

3. The compression apparatus according to claim 1, wherein the controller increases or decreases the set number of revolutions, depending on a degree of opening of the suction adjusting valve, from the set number of revolutions corresponding to selected one of the service conditions.

4. The compression apparatus according to claim 3, wherein:

the suction adjusting valve is a switching valve that is switched between a fully closed state and a fully opened state, and the controller increases or decreases the set number of revolutions depending on a percentage of a length of time the suction adjusting valve is in the fully closed state with respect to a unit of time.

5. The compression apparatus according to claim 4, wherein the controller decreases the set number of revolutions by a first fixed amount when a full close rate, which is the percentage of the length of time the suction adjusting valve is in the fully closed state with respect to the unit of time, is greater than a predetermined high rate limit, or increases the set number of revolutions by a second fixed amount when the full close rate is smaller than a predetermined low rate limit.

6. The compression apparatus according to claim 5, wherein the controller does not cause a further increase of the set number of revolutions when the set number of revolutions is greater than or equal to an initial value of the set number of revolutions.

* * * * *